US005567400A

United States Patent [19]

Mudge et al.

[11] Patent Number: 5,567,400

[45] Date of Patent: Oct. 22, 1996

[54] PROCESS FOR APPLYING A LOW SOILING FIBER FINISH

[75] Inventors: Elbert H. Mudge; Thomas D. Brabson, both of Charlotte, N.C.

[73] Assignee: Henkel Corporation, Plymouth Meeting, Pa.

[21] Appl. No.: 534,150

[22] Filed: Sep. 26, 1995

Related U.S. Application Data

[62] Division of Ser. No. 249,590, May 26, 1994, Pat. No. 5,491,004.

[51] Int. Cl.[6] ..... B05D 3/02

[52] U.S. Cl. ..... 252/8.62; 8/115.65; 8/194; 8/490; 427/393.4

[58] Field of Search ..... 252/8.6, 8.75, 252/8.8, 8.9; 422/393.4; 8/115, 65, 194, 490

[56] References Cited

U.S. PATENT DOCUMENTS

| | | | |
|---|---|---|---|
| 4,118,326 | 10/1978 | Login | 252/8.6 |
| 4,900,455 | 2/1990 | Kolbe et al. | 252/8.8 |
| 4,975,091 | 12/1990 | Becker et al. | 8/115.66 |
| 4,995,884 | 2/1991 | Ross et al. | 252/8.6 X |
| 5,116,682 | 5/1992 | Chakravarti et al. | 427/393.4 X |
| 5,173,341 | 12/1992 | Shiratori et al. | 427/434.6 |

*Primary Examiner*—Michael Lusignan

*Attorney, Agent, or Firm*—Wayne C. Jaeschke; Real J. Grandmaison; Henry E. Millson, Jr.

[57] ABSTRACT

A method for applying a low soil finish to spun synthetic textile fibers comprising applying to the spun fibers a low soil finish composition containing a dry, waxy solid component which comprises one or more of the following:

A) a bisamide of the formula $$\overset{O}{\overset{\|}{R}}CNH(R'NH)_xR'NH\overset{O}{\overset{\|}{C}}R'' \quad (I)$$

wherein R and R" can be the same or different and are straight or branched alkyl groups having from 7 to 19 carbon atoms, R' is a $C_2$–$C_4$ linear alkyl group, and x is an integer of from 0 to 5;

B) a block copolymer of ethylene oxide and propylene oxide;

C) the reaction product of a $C_{8-20}$ saturated fatty alcohol, a $C_{8-20}$ saturated fatty amine, or a phenol, with from 2 to 250 moles of ethylene oxide, and D) a $C_{8-22}$ fatty acid ester.

7 Claims, No Drawings

PROCESS FOR APPLYING A LOW SOILING FIBER FINISH

This application is a division of U.S. Ser. No. 08/249,590, filed May 26, 1994, now U.S. Pat. No. 5,491,004, patented Feb. 13, 1996.

BACKGROUND OF THE INVENTION

1. Field of the Invention

This invention relates to a process for applying a low soiling finish on synthetic textile fibers.

2. Statement of Related Art

Processes for applying low soiling and antistatic finishes on synthetic fibers are known in the art. Most applications of such finishes take place during the fiber spinning operation, and are known in the art as primary spin finishes.

Many compositions for low soil primary spin finishes are based on fluorocarbons. However, fluorocarbons present environmental problems, including the need for the treatment of wastewater to remove fluorine compounds from the water. In addition, fluorocarbons are expensive. Morever, in addition to the environmental problems associated with the use of fluorocarbons, .fibers treated with fluorocarbons tend to be hard and brittle.

The application of compositions for a primary spin finish on synthetic fibers, while effective, frequently results in coating of the fiber spinning equipment with the finish compositions, e.g. the Godet rolls. This results in the need for time-consuming and expensive cleaning operations, with concomitant down time for the equipment.

In an effort to avoid the above coating problems, fluorocarbons have been applied to fibers after the spinning operation, either as an overspray, or added to the dyebath, or as a final treatment of the dyed fibers.

DESCRIPTION OF THE INVENTION

Other than in the operating examples, or where otherwise indicated, all numbers expressing quantities of ingredients or reaction conditions used herein are to be understood as modified in all instances by the term "about".

The present invention relates to a method for applying a low soil finish as a secondary finish, i.e. a finish applied subsequent to fiber spinning, to the spun textile fibers. The low soil finish composition of the invention comprises a component which is at least one dry, waxy compound which is solid at room temperature selected from one or more of the following:

A) a bisamide of the formula $$\mathrm{RC({=}O)NH(R'NH)_xR'NHC({=}O)R''} \quad \text{(I)}$$

wherein R and R" can be the same or different and are straight or branched alkyl groups having from 7 to 19 carbon atoms, R' is a $C_2$–$C_4$ linear alkyl group, preferably ethylene, and x is an integer of from 0 to 5;

B) a block copolymer of ethylene oxide and propylene oxide;

C) the reaction product of a $C_8$–$C_{20}$ saturated fatty alcohol, a $C_8$–$C_{20}$ saturated fatty amine, or a phenol, with from 2 to 250 moles of ethylene oxide; and D) a $C_8$–$C_{22}$ fatty acid ester.

In the bisamide of formula I (component A) the R and R" groups preferably contain from 11 to 17 carbon atoms, and more preferably 17 carbon atoms.

Preferred compounds of formula I are those having the formula:

$$\mathrm{RC({=}O)NHC_2H_4NHC_2H_4NHC({=}O)R''} \quad \text{(II)}$$

in which R and R" have the meanings given above. The most preferred compounds of formula II are those containing at least one $C_{18}$ acyl group (R=$C_{17}$), e.g., DETA bisstearamide (diethylenetriamine bisstearamide), DETA lauryl/stearyl amide and the like. However, compounds in which R and R" contain from 11 to 15 carbon atoms are also of interest, e.g., DETA bislaurylamide, DETA lauryl/palmityl amide, DETA bispalmitylamide, and the like.

Component B), the block copolymer of ethylene oxide and propylene oxide can have one or more blocks of ethylene oxide and/or propylene oxide, e.g. an EO/PO copolymer, an EO/PO/EO copolymer, a PO/EO/PO copolymer, and the like, with a molecular weight such that the copolymer is a dry, waxy solid at room temperature. Typically, molecular weights of 3,000 to 25,000, normally 4,000 to 15,000 provide the desired properties. The particular size of the EO and PO blocks in the copolymers is not important provided the copolymer is a dry, waxy solid.

Component C), the reaction product of a saturated $C_8$ to $C_{20}$ fatty alcohol, a saturated $C_8$ to $C_{20}$ fatty amine or a phenol with from 2 to 250 moles of the ethylene oxide, preferably contains from 20 to 200 moles of ethylene oxide when component C) is the reaction product of a $C_8$ to $C_{20}$ fatty alcohol or a phenol, and preferably contains from 2 to 25 moles of ethylene oxide when component C) is the reaction product of a fatty amine. Preferred reaction products are those of a $C_9$–$C_{18}$ fatty alcohol or a phenol. Examples of preferred fatty alcohol reaction products include POE (23) lauryl alcohol and POE (20) stearyl alcohol.

The reaction products of a phenol are those phenols having the following formula

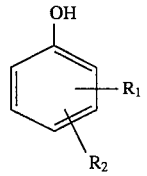

(III)

wherein $R_1$ and $R_2$ are hydrogen or alkyl groups having from 8 to 18 carbon atoms, provided that both $R_1$ and $R_2$ cannot be hydrogen. Examples of reaction products of the phenols of formula III include POE (150) nonyl phenol, POE (150) dinonyl phenol, POE (100) lauryl phenol, and the like.

Component D), the $C_8$–$C_{22}$ fatty acid ester is an ester of a $C_8$–$C_{22}$ saturated or unsaturated fatty acid with an alcohol which can contain one or more hydroxyl groups, such as $C_{12}$–$C_{20}$ fatty alcohols, ethylene glycol, glycerine, sugars, e.g. sorbitol, glucose, and the like. Here again, the fatty acid ester must be a dry, waxy solid at room temperature. Such fatty acid esters can also optionally be reaction products with from 2 to 250 moles of ethylene oxide. Examples of component D) include POE (200) castor oil, POE (200) hydrogenated castor oil, sorbitan monopalmitate, POE (16) sorbitan tristearate, ethylene glycol distearate, cetyl palmitate, and the like.

The compositions of the invention containing one or more of the above dry, waxy solids are preferably applied to the fibers in the form of aqueous emulsions or solutions which can contain from 1 to 50% by weight or more of the dry, waxy solids, preferably from 10 to 30% by weight, based on the weight of the emulsion or solution. Emulsifying agents can optionally be present when component A) is used alone, preferably nonionic emulsifiers, although when component A) is combined with one or more of components B) though D), the compositions are generally self-emulsifying. Other components can be present in the compositions, such as biocides, formaldehyde and rust inhibitors, e.g., the potassium salt of POE (2) 2-ethylhexyl phosphate.

The compositions of the invention can be applied to spun fibers by spraying the aqueous emulsion or solution onto the fibers, and allowing the fibers to dry at room temperature or by the use of low heat. Alternatively, the dry, waxy compounds can be sprayed on the fibers in the form of a melt.

The above compositions can also be used as a dyebath additive, applied to the dyebath at the beginning of the dye cycle. When applied to the dyebath, in addition to providing a low soil finish to the dyed fibers, the present compositions improve dyeing levelness and prevent channeling during the dyeing process. For woven and knit textiles, they help eliminate chafe cracks and rope marks.

The present compositions can also be applied to the dyed fiber as a last rinse.

The synthetic textile fibers that can be treated in accordance with the invention include nylon fibers, e.g., Nylon 6 and Nylon 6,6, including solution dyed nylon BCF carpet resin, polypropylene fibers, polyester fibers, acrylic fibers, and the like.

Component A) when applied to the fibers provides a non-removable low soil finish on the fibers. Components B) through D) provide a cleanable, i.e., removable, low soil finish on the fibers. Combinations of component A) with one or more of components B) through D) provides a partially removable and partially non-removable finish on the fibers. Preferably, a molar ratio of component A) to the total of one or more of components B)-D) is in the range of 50:50 to 80:20.

The present method provides many advantages over the usual prior art methods that employ fluorocarbons. The present method is low cost; avoids the use of fluorocarbons with their known disadvantages of cost and environmental problems such as the problem of treating fluorine residues in wastewater; and the providing of a flexible low soil system, i.e., where the treated fibers are completely cleanable, completely non-removable, or a combination thereof.

The treated fibers and fabrics and carpets made from them exhibit excellent resistance to soiling, at least as good as fluorocarbon treated fibers.

The invention will be illustrated but not limited by the following examples.

EXAMPLES

Example 1

To warm water in a stainless steel vessel there was added POE (2)-2-ethylhexyl phosphate, potassium salt, and the resulting mixture stirred for 30 minutes. Then a PO-EO-PO block copolymer having a number average molecular weight of 4550, and a biocide (TROYSAN®174) were added with stirring to the stirred mixture.

The above ingredients were added in the following molar ratios:

| molar ratio | ingredient |
|---|---|
| 38.80 | water |
| 60.00 | PO-EO-PO block copolymer |
| 2.00 | POE(2)-2-ethylhexyl phosphate, K salt |
| 0.20 | biocide |
| 100.00 | |

The formulation was in the form of a clear water-white liquid with a pH (1% aqueous solution) of 7.0.

Example 2

To a stainless steel pressure reactor there is added water, and heat is applied until the temperature of the water reaches 90° C. Then POE (30) stearyl alcohol and POE (40) cetyl/stearyl alcohol are added with stirring. Then molten DETA bisstearamide is added, the reactor is sealed and heated to 130° C. The pressure in the reactor builds to 40–45 psig. The reactor contents are maintained at 130° C. for one hour, rapidly cooled to 90° C. and the reactor vented.

The above ingredients are added in the following molar ratio:

| molar ratio | ingredient |
|---|---|
| 79.7 | water |
| 2.0 | POE (30) stearyl alcohol |
| 1.0 | POE (40) cetyl/stearyl alcohol |
| 17.3 | DETA bisstearamide |
| 100.0 | |

The above composition is an opaque emulsion.

Example 3

To a stainless steel blending vessel water is added and heated to a temperature of 55°–60° C. POE (20) stearyl alcohol is then added and the resulting mixture stirred until a clear solution is obtained. Heating is then discontinued and emulsified DETA bisstearamide prepared in accordance with Example 2 is added with stirring for an additional 15 minutes. The resulting composition is a milky white emulsion having a pH (1% solids) of 8–9 and containing 20% solids.

The above ingredients are added in the following molar ratios:

| molar ratio | ingredient |
|---|---|
| 40.0 | water |
| 10.0 | POE (30) stearyl alcohol |
| 50.0 | emulsified DETA bisstearamide |
| 100.0 | |

Example 4

The formulation of Example 1 was diluted to 1 part per 3.5 parts of water and sprayed on solution dyed nylon BCF spun carpet yarn. The sprayed yarn after drying contained a low soiling coating that could be removed if and when desired by treatment with steam or hot water.

We claim:

1. A method for applying a low soil secondary finish to synthetic fibers comprising treating spun fibers with a coating effective quantity of a composition comprising a dry waxy component solid at room temperature selected from at least one compound from the group consisting of A) a block copolymer of ethylene oxide and propylene oxide;

B) the reaction product of a $C_{8-30}$ saturated fatty amine or a phenol with from 2 to 250 moles of ethylene oxide, and C) a $C_{8-22}$ fatty acid ester.

2. The method of claim 1 wherein the dry waxy component consists of at least one component A).

3. The method of claim 2 wherein component A) is an EO-PO-EO block copolymer, a PO-EO-PO block copolymer, or a mixture thereof.

4. The method of claim 1 wherein the dry waxy component consists of at least one component B).

5. The method of claim 4 wherein component B) is selected from the group consisting of POE (150) dinonyl phenol, POE (150) nonyl phenol, and POE (2) hydrogenated tallow amine.

6. The method of claim 1 wherein the dry waxy component consists of at least one component C).

7. The method of claim 6 wherein component C) is selected from the group consisting of POE (200) castor oil, POE (200) hydrogenated castor oil, sorbitan monopalmitate, POE (16) sorbitan tristearate, ethyleneglycol distearate, and cetyl palmitate.

* * * * *